United States Patent [19]

Huber

[11] Patent Number: 4,627,327

[45] Date of Patent: Dec. 9, 1986

[54] HYBRID UNITIZED SHOCK AND VIBRATION MITIGATION SYSTEM

[75] Inventor: Michael S. Huber, Milpitas, Calif.

[73] Assignee: The United States of America as represented by the Secretary of the Navy, Washington, D.C.

[21] Appl. No.: 740,673

[22] Filed: Jun. 3, 1985

[51] Int. Cl.[4] ..... F41F 3/04

[52] U.S. Cl. ..... 89/1.816; 89/1.810

[58] Field of Search ..... 89/1.816, 1.819, 1.8, 89/1.810; 277/199

[56] References Cited

U.S. PATENT DOCUMENTS

| | | | |
|---|---|---|---|
| 3,072,022 | 1/1963 | Wood et al. | 89/1.810 X |
| 3,166,978 | 1/1965 | Price et al. | 89/1.816 |
| 3,289,533 | 12/1966 | Brown | 89/1.810 |
| 3,392,629 | 7/1968 | Soderberg | 89/1.816 |
| 3,823,903 | 7/1974 | Kendall et al. | 89/1.8 |
| 3,857,321 | 12/1974 | Cohen | 89/1.816 X |
| 4,399,999 | 8/1983 | Wold | 89/1.816 X |
| 4,406,211 | 9/1983 | Andersen | 89/1.816 |
| 4,433,848 | 2/1984 | Williams | 89/1.816 X |
| 4,485,719 | 12/1984 | Mendelsohn et al. | 89/1.816 |

*Primary Examiner*—David H. Brown

*Attorney, Agent, or Firm*—R. F. Beers; C. D. B. Curry; G. L. Craig

[57] ABSTRACT

A system for reducing the shock and vibration transmitted to a missile during transportation, stowage or launch. Rings of segmented shock-absorbing pads are disposed along the launch tube in the annular space between the missile and the tube. These pad segments are unitized by a circumferential tensile fiber hoop connecting the pad segments, and portions of this unitizing hoop are used to form control loops between these pad segments. The loop characteristics may be selectively varied to control the effective modulus and circumferential length of each unitizing hoop thus varying the force/deflection characteristics of the pad ring.

4 Claims, 7 Drawing Figures

HYBRID UNITIZED SHOCK AND VIBRATION MITIGATION SYSTEM

BACKGROUND OF INVENTION

1. Field of Invention

The invention relates to a system for reducing the shock and vibration transmitted to a missile in a launcher. Specifically, the invention relates to a system for reducing shock and vibration transmitted to a missile in a launcher by providing selective variation of the force/deflection characteristics of the launch and stowage pads in the annular space between the missile and the launcher.

2. Description of Prior Art

Launch pads and stowage pads are used in present missile launching systems to maintain missile alignment, mitigate shock and vibration, and to provide lateral support to the missile during launch. Present systems use a plurality of pad units containing chevron shaped struts to perform these functions. The force/deflection characteristics of these struts have a desirable characteristic plateau which allows a fair amount of lateral excursion at a relatively constant force. Due to the segmented nature of the pad units and the curved annular space, however, the desirable plateau characteristic is considerably diminished when the overall pad row (ring level) force/deflection characteristics are developed. The present invention avoids this limitation and provides a space efficient suspension system which generates a constant restoring force over a relatively large range of motion in any direction. Thus it essentially provides a structure which can attain the desirable plateau characteristic even at the ring level.

The multiple functions of the launcher lateral support system mentioned above usually necessitate compromises in conventional pad designs to allow creation of a set of lateral support system force/deflection curves which can perform all of the required functions of any selected launcher mode within adequate but not optimum limits. These adequate but not optimum limits are dictated by the performance limitations of a conventional pad system and by the need to meet a variety of operational modes with a single characteristic set of force/deflection curves. The hybrid pad unitizer system offers two principal advantages. One is that the greater design flexibility of a hybrid pad unitizer system allows a more ideal set of force/deflection characteristics to be created. The second advantage is that the proposed hybrid pad unitizer system may be made externally adjustable such that the force/deflection characteristics can be modified to optimize the lateral support system performance for the particular launcher mode. This allows construction of an adjustable lateral support system whose force/deflection characteristics can be modified to best suit the launcher mode.

SUMMARY OF THE INVENTION

A shock and vibration mitigation system for a missile launcher in which a series of pads are arrayed as rings in the annular space between the missile and the launcher. The pads in each ring are connected by hoops of a tensile material along the inner circumference of the pad ring. At spaced intervals along the unitizing hoop, small loops are formed in the tensile material and these loops may be selectively varied in size to control the overall modulus and/or effective size of each ring. Thus a launcher lateral support system is achieved in which the force/deflection characteristic of the support system can be varied to optimize the support system for any given launcher mode.

A primary object of invention is to provide a launcher lateral support system having more ideal force/deflection characteristics to optimize launcher performance. Another object of invention is to provide an adjustable launcher lateral support system in which the loops located between the segmented pads contain adjustable loop controllers which can be made externally adjustable and which modify the force/deflection characteristics of the unitized pad ring.

DESCRIPTION OF THE PREFERRED EMBODIMENT

Figure 1:
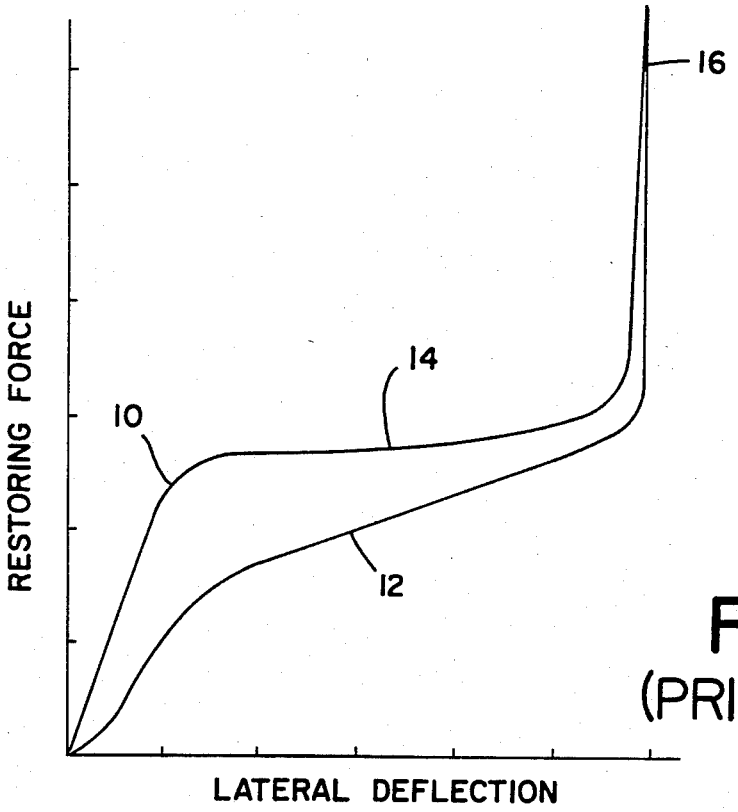
FIG 1 (PRIOR ART)
FIG. 1 is a plot of a typical force/deflection curve for a chevron strut used in conventional launcher lateral support systems.

Most present launcher systems employ elastomeric liner materials in the annular space between the missile and the launch tube. These liner materials are used to maintain stowed missile alignment, to limit shock and vibration inputs to the missle, and to control lateral excursion of the missile during launch. The above requirements are typically somewhat in conflict when a system with a single characteristic set of force/deflection curves is utilized. Present submarine based launching systems employ cast polyurethane and neoprene liner pads with pre-buckled chevron struts, as this system does an adequate job of meeting the excursion performance criteria while possessing good drainability, chemical stability in seawater, and the high mechanical strength required to withstand the forces developed during launch. A characteristic force/deflection curve of such pre-buckled chevron struts which results from the pad mechanical configuration and elastomeric properties is shown in FIG. 1. The curve illustrates the response of the struts as a load is applied 10 and as the load is removed 12. It is most desirable that a lateral support system have a force/deflection characteristic resembling a plateau region 14 during lateral excursion of the missle so that the restoring force of the pads is relatively constant with increased lateral deflection. This plateau force is selected to provide a maximum resistance to missile lateral excursion without locally overstressing the missile skin. The curve also illustrates the region 16 in which the support pad bottoms out under the applied load.

Figure 2:
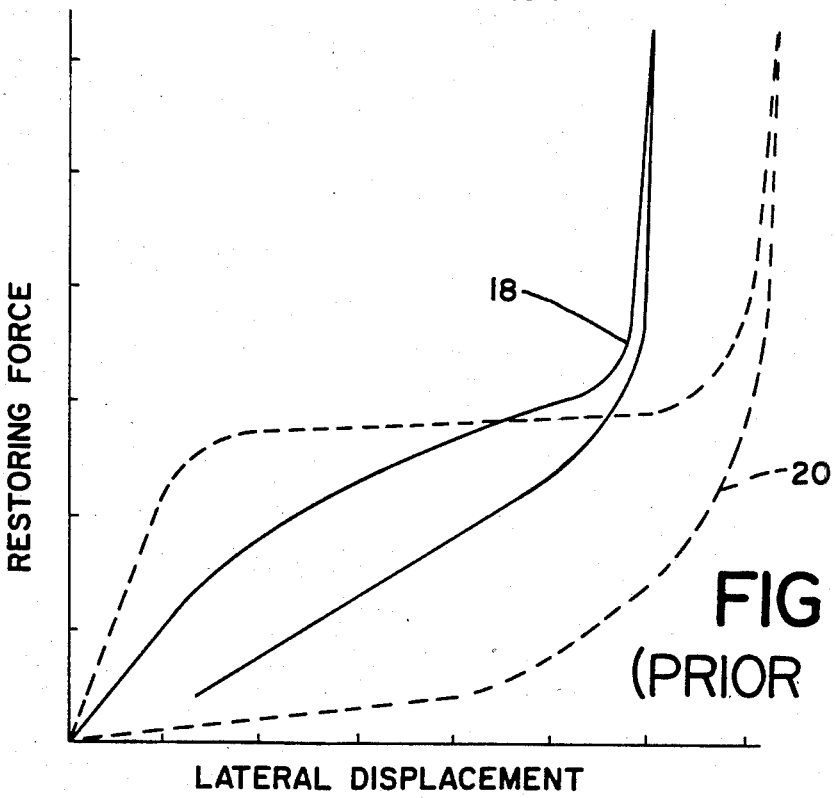
FIG 2 (PRIOR ART)
FIG. 2 is a ring level comparison force/deflection plot of a conventional launcher lateral support system using pads formed of chevron struts and a plot of an ideal launcher lateral support system.

FIG. 2 compares a typical ring level force/deflection plot 18 of a conventional lateral support system using individual pads with chevron struts against a plot 20 of an ideal lateral support system. Note that the plateau region 14 in FIG. 1 for the chevron strut begins to skew into a slanted region for the ring level plot 18. An ideal system would retain the plateau characteristic at the ring level as well as permitting greater lateral displacement before bottoming out. Thus a more efficient lateral support system would result from a design which exhibited a launcher system force/deflection curve similar to plot 20 in FIG. 2 rather than the degenerate form represented by plot 18 in FIG. 2. To satisfy the multifunction roles of a lateral support system it would be desirable to have the capability of being able to change the force deflection characteristics of the lateral support system to better suit the launcher system mode, be it transportation, stowage, or launch.

It should be noted that present submarine based systems employ stowage pads in the lower section of the launcher and launch pads in the upper section. These two types of pads have different force/deflection characteristics in order to increase overall launcher performance. The configuration described herein for the hybrid lateral support system allows construction of a non-adjustable system having increased design flexibility with ring level force/deflection characteristics superior to present systems or an externally adjustable system. In addition, the hybrid lateral support system of the present invention utilizes a pad unitizer scheme which incorporates provisions to vary the effective hoop length so that the lateral support system F/D characteristics can be modified to meet the requirements of the launcher mode.

With conventional lateral support systems, compression of the chevron struts within each segmented pad is the major contributor to lateral support system performance. Since strut compression can only occur over some portion of the missile which is eccentrically disposed into the lateral support system, the system is inherently inefficient as the struts into which the missile is not disposed contribute nothing to lateral support system performance. A unitized pad ring is more efficient in restoring a missile to its original position than conventional pad units because more of the chevron struts become involved in resisting missile motion. The tensile fiber loops are used to control the amount of "unitization" of the pad units. The present invention thus provides increased rattlespace, defined as available space for lateral movement of the missile within the launcher without "bottoming" the lateral support system, and also provides greater shock protection for a given maximum acceleration of the missile. It additionally increases crossflow capability (the sea speed of the submarine at which a missile can successfully be launched) due to greater allowable missile excursion and permits greater tolerance of the positioning equipment used during missile onloading.

As mentioned above, the use of chevron strut compression within rings of separated pad units in present lateral support systems is inherently inefficient, yet the chevron strut configuration has been carefully developed to give the desirable characteristic plateau type force deflection curve shown in FIG. 1. At the risk of oversimplification, the general goal of a lateral support system is to reach the maximum restoring force permitted by missile loading limitations with as little deflection as possible and then maintain this "plateau loading" throughout the excursion range. The chevron strut does a good job of this at the strut level, but due to the inefficiencies mentioned earlier, the typical ring level F/D curve generated looks like curve 18 in FIG. 2. An ideal system would generate a *ring level* curve which resembles curve 20 in FIG. 2 and the hybrid unitizer system allows achievement of this by controlling the amount of unitization of the pad ring. Merely unitizing the segmented pads of prior art support systems by connecting them with tensile fibers will not result in a ring level curve like the curve in FIG. 1 or curve 20 in FIG. 2 because the characteristic shear and tension F/D curves for chevron struts do not have the needed plateaus. However, by forming loops in the tensile fiber between the segmented pads and then placing inserts in the loops, loop controller breakout mechanisms are created (i.e. the loop controller F/D curve has the requisite plateau). Thus the unwanted portion of the tension and shear F/D curve contributions are eliminated by simply allowing the effective hoop size to increase (i.e. decreasing the amount of pad segment unitization) when a hoop tension corresponding to the desired ring level lateral support system plateau is reached.

Figure 3:
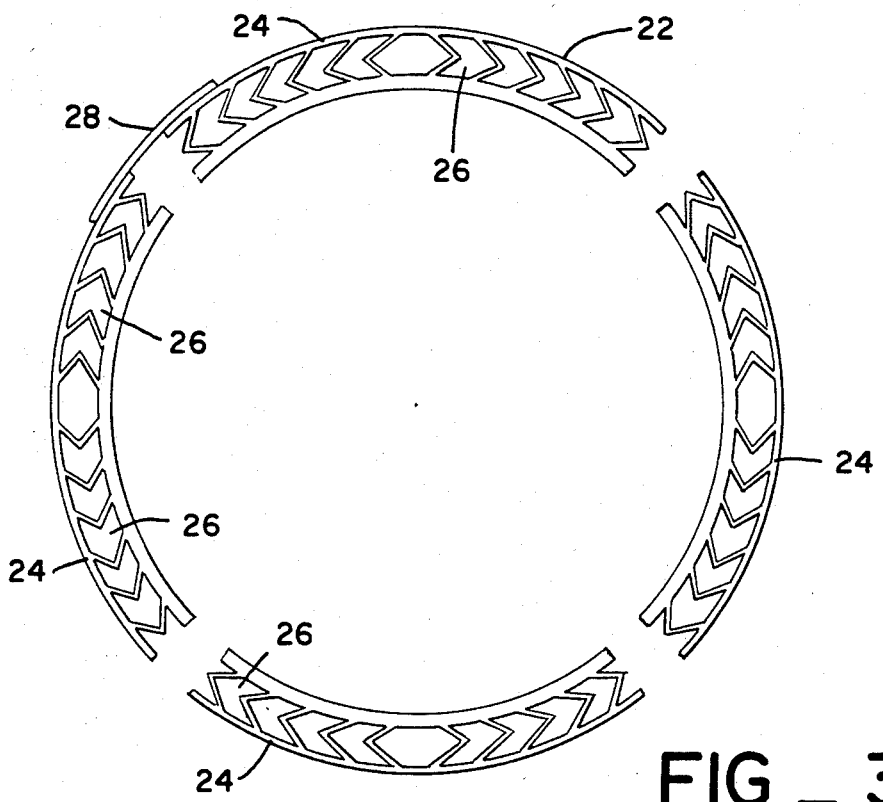
FIG 3 (PRIOR ART)
FIG. 3 is a sectional-view of a missile launch tube having a prior art shock absorbing system arranged therein.

A prior art support system of unconnected segmented pads is shown in FIG. 3 as it is typically positioned within the launcher tube. A pad ring 22 is shown as being composed of a series of segmented pads 24, each of which is formed of a number of chevron struts 26. The outer circumference of the pad ring 22 is bonded to the inner face of the launcher 28, only a portion of which is shown here.

Figure 4:
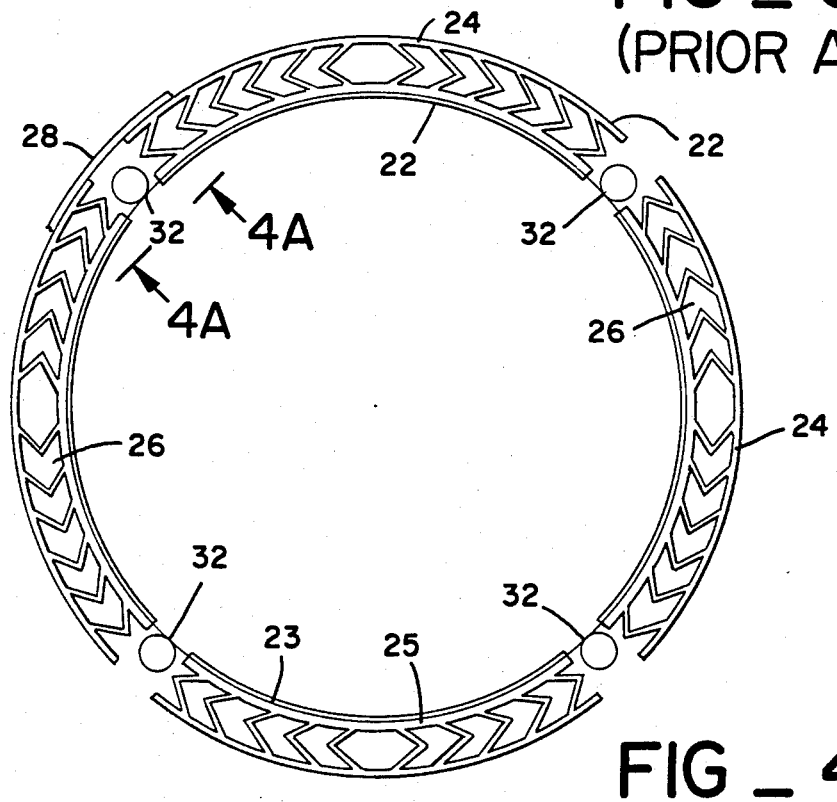
FIGS. 4 and 4A are sectional views of a missile launch tube having a shock absorbing system made in accordance with the present invention arranged therein.
Figure 4A:
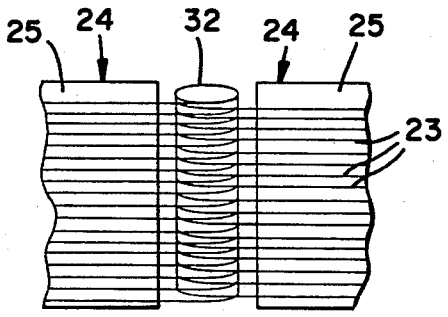

The hybrid pad unitizer system of the present invention is shown in FIG. 4. A tensile fiber unitizing hoop 23 connects all of the pad segments 24 making up a pad ring 22. The unitizing hoop 23 may be bonded to the inner face 25 of the pad ring 22 or molded integrally within the inner face 25. Small circular loops 32 formed as integral parts of the unitizing hoop 23 are located in the space between pad segments 24. Eccentric motion of the missile, not shown, tends to reduce the size of the control loops 32 thereby increasing the effective circumference of the unitizing hoop 23. By using inserts, not shown, within each loop 32 to control the size of each loop, loop controllers are created which control the circumferential growth of the unitizing hoop. Depending on the type of insert selected, the loop controller may be made externally adjustable. As a result, the force/deflection characteristics of such a unitized pad ring are now dependent on three principle variables: (1) pad mechanical geometry; (2) pad unit material properties; and (3) the effective circumference of the tensile fiber hoop 23 which is in turn controlled by the loop controllers. Note that the effective circumference of the hoop 23 is also dependent on the tensile modulus of the hoop 23. FIG. 4A shows how such control loops 32 might be formed in the area between the edges of the support pads 24.

The effective size of the loop 32 essentially controls the amount of lateral missile excursion which is required before the pad units 23 mounted away from the direction of missile motion start to transfer force into the hoop 23. The bounds on the size of the pad unitizer hoop 23 are: (1) the smallest hoop would be one which just allows missile insertion with large missile/large launch tube tolerance extremes, and (2) the largest hoop would be one that essentially allows the pad units to act individually. A principal idea of the hybrid lateral support system is to make sure of the wide range of force/deflection curves which can be generated by utilizing loop controllers to control hoop length so that the pad units can act independently or as a unitized pad ring or at any point in between.

Since the loop controllers are used to control the effective hoop size, the consequently control the amount of force which the pad units mounted away from the direction of missile motion transfer into the hoop and therefore into the missile. This feature results in a tremendous increase in lateral support system design flexibility. This arises because: (1) strut compression is no longer the only contributor to lateral support system performance, and (2) the potential problems previously associated with utilizing different pad geometries or materials can now be minimized by utilizing the loop controllers as "breakout mechanisms" to control any undesirable effects.

Figure 5:
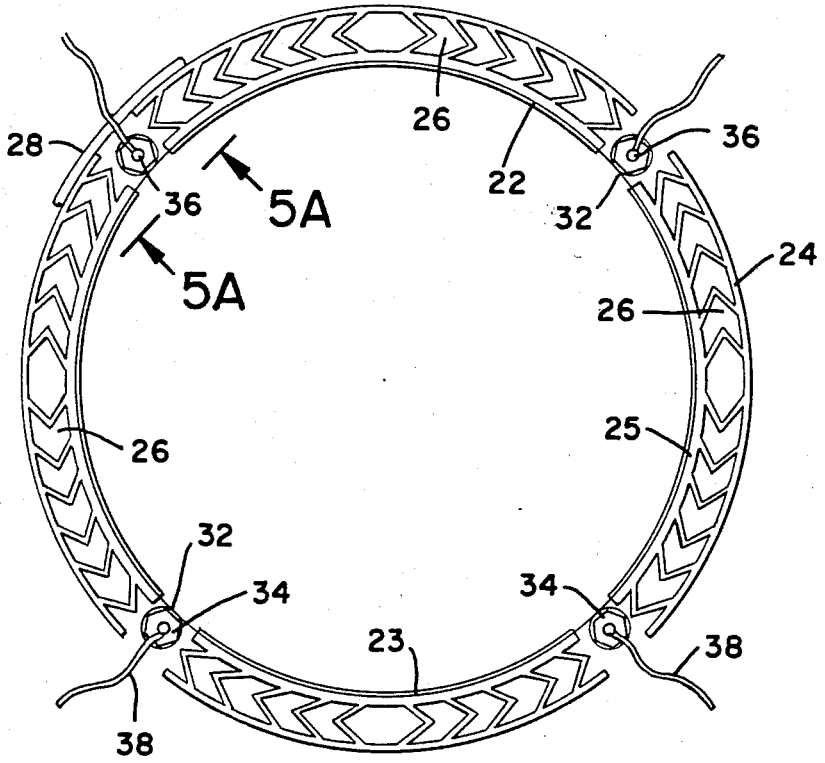
FIGS. 5 and 5A are sectional views of a missile launch tube having a shock absorbing system made in accordance with an alternative embodiment of the present invention arranged therein.
Figure 5A:
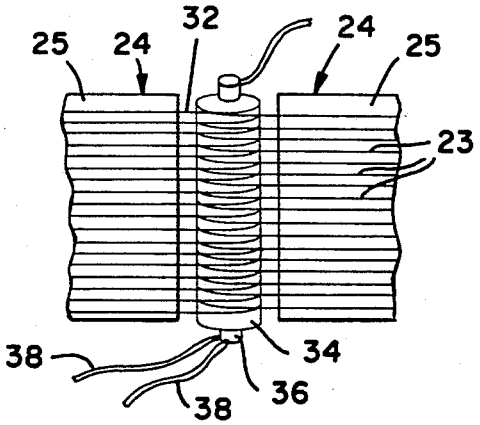

Referring to FIG. 5 and FIG. 5A, one method of providing externally adjustable loop controllers is shown. Air bladders 34 could be used to fill the small loops 32, and the pressure could be varied to control the effective size of the hoop 23. Check valves 36, electrically adjustable by inputs 38 from an external source, could be used to vary the breakout hoop tension. If a non-externally-adjustable system would suffice, cylindrical tubes with buckling modes already initiated, made of a variety of materials could be inserted into the control loops 32. Various hydraulic and purely mechanical systems could also be employed. A system utilizing the eject gas to decrease the effective hoop length could be developed to make the lateral support system stiffer in launch than in shock.

The following examples demonstrate some ways in which the present invention can increase lateral support system design flexibility and potentially solve some typical lateral support system problems. Where increased rattlespace is desireable, the hybrid pad unitizer system allows pad unit construction with stiffer urethane systems and a consequent decrease in pad unit compressed height (thereby increasing rattlespace and launcher performance). This is made possible by utilizing the loop controller F/D characteristic to control the rate sensitivity of the stiffer urethane systems which has prevented this type of approach in the past. The same feature would eliminate the present dependence on specific urethane systems due to the criticality of the rate sensitive material properties. Sections of pad units could be built with strut configurations optimized for shear and tensile loadings rather than compressive loadings. A creepless lateral support system could be constructed by using circumferentially oriented metallic chevron struts (like the shear struts in a prior art pad unit) in a portion of each pad unit to prevent creep in the shear direction. This high shear stiffness would normally cause problems in shock and/or launch (due to overloading of the missile skin), but "breakout type" or adjustable loop controllers could be used to limit the lateral support system plateau in these launcher modes.

What is claimed is:

1. A shock absorbing system circumferentially arrayed within a launch tube around a missile comprising:

(a) a first plurality of arcuate sheets bonded to said launch tube;

(b) a second plurality of regularly segmented arcuate sheets also spaced radially inward from said first plurality of arcuate sheets;

(c) a structured array of shock absorbing struts located between said first and said second plurality of arcuate sheets to form a plurality of regularly segmented pad rings positioned about said missile;

(d) means for connecting said plurality of regularly segmented pad rings such that lateral movement of said missile into any portion of said pad rings is resisted by all of said shock absorbing struts in said pad rings; and (e) means for varying the shock absorbing characteristic of said means for connecting said pad rings.

2. The shock absorbing system of claim 1 wherein said means for connecting is a tensile fiber hoop connecting the said second plurality of regularly segmented arcuate sheets, said hoop having circular loops integrally formed in said hoop, said loops located between segments of said second arcuate sheets.

3. The shock absorbing system of claim 1 wherein said means for varying is a cylindrical insert positioned inside a plurality of said loops, said insert having predetermined buckling properties.

4. The shock absorbing system of claim 1 wherein said means for varying is a cylindrical air bladder positioned inside a plurality of said loops, said bladder having the capability of external dimensional adjustment.

* * * * *